US006844304B2

(12) United States Patent
Lunner et al.

(10) Patent No.: US 6,844,304 B2
(45) Date of Patent: Jan. 18, 2005

(54) PICKLING AGENT CONTAINING UREA AND METHOD OF PRODUCING IT

(75) Inventors: Sven-Eric Lunner, Avesta (SE); Fredrik Hägg, Uppsala (SE)

(73) Assignee: Avestapolarit Aktiebolag (Publ), Stockholm (SE)

( * ) Notice: Subject to any disclaimer, the term of this patent is extended or adjusted under 35 U.S.C. 154(b) by 101 days.

(21) Appl. No.: 10/168,990

(22) PCT Filed: Jan. 12, 2001

(86) PCT No.: PCT/SE01/00060

§ 371 (c)(1),
(2), (4) Date: Jun. 26, 2002

(87) PCT Pub. No.: WO01/53567

PCT Pub. Date: Jul. 26, 2001

(65) Prior Publication Data

US 2003/0004080 A1 Jan. 2, 2003

(30) Foreign Application Priority Data

Jan. 19, 2000 (SE) ..... 0000147

(51) Int. Cl.[7] ..... C11D 17/00
(52) U.S. Cl. ..... 510/245; 510/499; 134/41; 134/3
(58) Field of Search ..... 510/499, 245; 134/3, 41

(56) References Cited

U.S. PATENT DOCUMENTS 3,598,741 A 8/1971 Kanno et al.
5,266,410 A * 11/1993 Lindert et al. ..... 428/461

FOREIGN PATENT DOCUMENTS

| | | |
|---|---|---|
| DE | 3412329 A1 | 10/1985 |
| GB | 2 048 311 A | 12/1980 |
| SE | 8305648-1 | 10/1983 |
| WO | WO 95/35397 | 12/1995 |

OTHER PUBLICATIONS

Oda Terumi et al.; Scale removal from stainless steel pipe—by immersing pipe in aq. soln. contg. nitric acid, hydrofluoric acid and urea; J54056939; May 8, 1979.

Shimogoori Kazutoshi et al.; Pickling metal, e.g., titanium or stainless steel—in soln. contg. nitric acid, hydrofluoric acid and urea or sulphamic acid, with controlled prodn. of undesired nitrogen oxide; JP61015989 A; Jan. 24 1986.

Kotake Masayoshi et al.; Reagent for inhibiting generation of nitrogen oxide—from nitric acid pickling bath, contains sulphuric acid, acidic ammonium sulphate, urea and sulphuric acid; JP57019385 A; Feb. 1, 1982.

* cited by examiner

*Primary Examiner*—Necholus Ogden
(74) *Attorney, Agent, or Firm*—Nixon & Vanderhye

(57) ABSTRACT

A long-time stable pickling agent for the removal of an oxide layer on a stainless steel after heat treatment, such as welding, which pickling agent comprises nitric acid and fillers and constitutes of a pickling paste or pickling gel to be coated on the heat treated stainless steel, or of a pickling liquid to be sprayed on the steel. According to the invention, the pickling agent also comprises urea for reduced formation of nitrous fumes when the pickling agent is used.

20 Claims, 4 Drawing Sheets

PICKLING AGENT CONTAINING UREA AND METHOD OF PRODUCING IT

TECHNICAL FIELD

The present invention relates to a long-time stable pickling agent containing fillers for the removal of an oxide layer on a stainless steel after heat treatment, such as welding, which pickling agent comprises nitric acid. Such pickling agents, in the form of pastes/gels or spray liquids, are used in the machining industry (e.g. in mechanical workshops) for the removal of an oxide layer on the steel after welding etc., or for general cleaning of the steel after treatment thereof.

PRIOR ART

At the heat treatment of stainless steels, such as welding, an oxide layer of primarily $Cr_2O_3$, FeO, $SiO_2$, and MnO is formed on the surface of the steel, and around the heat treated area as well as on the welding joint itself Said layer must be removed, so that the stainless steel will obtain the desired surface properties, including a normal passivated layer, with the proper chromium content. Such a removal is commonly achieved through treatment with a refined pickling agent, such as a pickling paste or pickling gel, which is coated on the steel in the region of the welding joints, or a pickling liquid, which is sprayed, normally over larger regions, to obtain a more comprehensive cleaning after the treatment of the steel. The paste/liquid contains a filler to increase the viscosity of the agent and hence improve its adherence against the steel surface and to reduce the splash risk. When the pickling agent has acted for some time, normally about one hour, it is flushed off by water.

The pickling agents of today are often based on so called mixed acid, i.e. a mixture of nitric acid ($HNO_3$) and hydrofluoric acid (HF). Pickling with mixed acid yields good pickling results and is economic as well, but results in environmental problems which are difficult to solve and which occur at the oxidation of the metal by the nitric acid, the nitrous fumes ($NO_x$) and nitrates being emitted to atmosphere and water. New pickling methods have been developed after recent requirements for a better working environment and laws concerning emission to air and waste water from the processing industry. The alternative which has recently appeared on the market is so called pickling without nitrates, i.e. the nitric acid being replaced by another oxidizing chemical agent. Instead of $HNO_3$, for instance $Fe^{3+}$, hydrogen peroxide ($H_2O_2$), and $H_2SO_4$ are used, which gives good pickling effect but not quite as good as the nitric acid. However, with the alternative oxidation agents, emissions of NO, and nitrates are avoided.

When pickling gels, pastes and spray liquids are concerned, there is, however, a problem to find an oxidation agent which is sufficiently effective, easy to handle, and at the same time long-time stable. Many of the nitrate-lacking pickling agents are for instance very difficult to handle, taking into consideration that the user is often not especially skilled in the matter; often it is the question of small mechanical workshops who use the pickling agents. The stability is as important, as the pickling agents are stock articles, which can be stored for a long time before they are used.

The type of pickling agent, which is the purpose of the present invention, shall withstand storage in several links of the sales chain, withstand shipment over the whole world, and withstand storage with the consumer. A known, but less efficient agent for the $NO_x$-reduction in connection with pickling agent of the discussed type is potassium permanganate. However, a pickling agent with the addition of a potassium permanganate is very instable and hence such an agent is today sold over the world as a bicomponent agent. According to international safety laws, it is however not permissible to co-load potassium permanganates and pickling agents, when they are to be shipped, which implies a very great disadvantage and is a great problem in the trade. Further, when such an agent is to be used, the potassium permanganate has to be mixed into the pickling agent just before the agent is to be used, and then the entire batch must be used within 24 hours.

When continuous pickling baths with mixed acid are concerned, which are used for the pickling of continuous steel strips at their manufacture, the steel normally being brought to run through the pickling bath to remove the oxide layer which has been formed at e.g. treatments such as cold rolling, hot rolling and annealing, tests have been made with an addition of urea in the pickling bath to reduce the formation of nitrous fumes and nitrates. However, at the neutralisation of the residue products from the pickling using urea, certain complications have appeared, such as the formation of ammonia ($NH_3$). Further, there is a risk of formation of ammonium nitrate ($NH_4NO_3$) in the pickling baths, said nitrate possibly depositing in suction ducts. Ammonium nitrate is explosive at high temperatures or at contact with fire. The most probable scenario is, however, that droplets of pickling acid are emitted when the formation of gas arises at a too rapid addition of urea. The droplets of pickling acid are then brought into the sucking ducts where ammonium nitrate and $FeF_3$ may be deposited on the cold walls.

A number of patents are known, which disclose such utilization of urea in the pickling bath. In DE 3 412 329 a pickling bath with a mixed acid is disclosed, wherein urea is added in amounts which are adjusted after continuous $NO_x$-analysis in a flue duct. In GB 2 048 311 pickling baths with mixed acid and urea are disclosed. It is mentioned that the pickling efficiency is increased, when a certain mol ratio urea/nitric acid is kept, namely preferably not more than 1. A theory is also described about what is happening when "too much" urea is added. The indicated, suitably used amounts of urea are then 0.05 to 5 percent by weight. Also in the Abstract of JP 57 019 385 the use of urea in an amount of 0.1 to 5% in a pickling bath is described for the utilization in connection with the manufacture of steel. In SE 8305648 a pickling bath with mixed acid and urea is disclosed, the patent being directed towards urea being added from the bottom of the pickling bath. In the Abstract of JP 61 015 989 pickling baths with mixed acids and about 5 g/l urea is disclosed. U.S. Pat. No. 4,626,417 is a more general patent concerning $NO_x$-reduction with a mixture of urea and sulphuric acid. In Example 1 a feasible utilization in pickling baths is shown. In the Abstract of JP 54 056 939 a pickling process is disclosed, which is utilized in connection with the manufacture of stainless steel tubes, in which process urea is added at a final stage when the pickling bath has already been heated to 30 to 70° C.

Already in 1979 it was disclosed in GB 2,048,311 and JP 54 056 939 to use of urea in a pickling bath for continuous pickling of stainless steels in connection with the manufacture of the steels. Although the technique thus has been known for more than 20 yeas, there is today, as far as the applicant with his wide knowledge within the art knows, no commercial process utilizing urea in pickling baths for continuous pickling. The reason probably is that it has proved that quite a lot of problems arise in connection with the utilization of urea. As also can be seen from a plurality of known patents, the use of urea in pickling baths is not easy to perform. Specifically, the durability of the pickling agent is a problem. In e.g. SE 8305648 it is suggested, as mentioned above, that the problems in connection with the use of urea can be solved through addition of urea in a special manner, from the bottom of the pickling bath. GB 2,048,311 discloses that too much urea must not be used, more exactly maximum 5 percent by weight, and that urea has to be added during the progress of the pickling process. As can be seen in JP 61,015,989, the urea content must be controlled during the performance of the process. In spite of all these suggestions on how to solve the problems related to the utilization of urea, there is today, after more than 20 years, no commercial process. Even less has somebody suggested that urea could be used in an pickling agent according to the present invention, i.e. a pickling agent intended for use by unskilled users without any possibility to control the progress of the process, which agent also must withstand storage for a long period.

Contrary to the above references, which relate to pickling baths for the pickling of stainless steels in connection with their manufacture, SE 504,733 and U.S. Pat. No. 3,598,741, respectively, disclose pickling agents, which are more similar to the pickling agent of the present invention, i.e. a long-time stable pickling agent for the removal of an oxide layer on stainless steels after heat treatment, e.g. welding, which pickling agent comprises nitric acid and fillers and constitutes of a pickling paste or pickling gel to be coated on the heat treated, stainless steel, or of a pickling liquid to be sprayed on the steel. However, none of these two references mentions anything about the use of urea to reduce the formation of $NO_x$ when using the pickling agent.

BRIEF DISCLOSURE OF THE INVENTION AND ITS ADVANTAGES

The present invention aims at tackling the above group of problems and, more particularly, to provide a pickling agent, which is efficient, easy to handle, and long-time stable, while it causes insignificant emissions of nitrous fumes when utilized. Further, it shall be possible to ship the agent according to the invention in finally mixed composition and to open and re-seal the receptacle of the agent several times, only a portion of the agent being consumed at each occasion, without the agent losing its effect.

Therefore, according to the present invention, a pickling agent is provided of the type mentioned in the preamble, which pickling agent also includes urea in order to reduce the formation of nitrous fumes at the utilization of the pickling agent.

According to one aspect of the invention, the pickling agent consists of a pickling paste or a pickling gel to be coated on the heat treated, stainless steel, or of a pickling liquid to be sprayed on the steel. The amount of urea in the pickling agent should be at least 0.5 g/l, but max 200 g/l. According to one embodiment of the invention, it may be sufficient with urea amounts in the lower part of said interval, preferably max 80 g/l, and more suitably max 50 g/l. According to another embodiment, it might, however, be suitable for the reduction of nitrous fumes and for the result to use larger amounts of urea, preferably at least 60 g/l, and still more preferred at least 80 g/l, but max 200 g/l, preferably max 160 g/l.

The amount of nitric acid added should be 15 to 30 percent by weight, preferably 17 to 27 percent by weight, and still more preferred 19 to 25 percent by weight. At the very pickling, the amount of nitric acid in the agent should not exceed 23 percent by weight. However, the amount of nitric acid added to the agent may exceed 23 percent by weight, according to the interval just indicated, as some of the nitric acid is consumed by the added urea.

Thanks to the urea content in the pickling agent, the formation of nitrous fumes is drastically reduced when using the pickling agent on oxidized, stainless steels. A related advantage is that the ratio $NO:NO_2$ is displaced towards a larger amount of NO, when urea is used in the pickling agent. This is a positive advantage, as NO is less unhealthy to humans than is $NO_2$. The limit value is 25 times lower for $NO_2$ than for NO.

Yet another advantage is that $N_2$ and $CO_2$, which are formed at the pickling in presence of urea, contribute to the loosening up of the oxide surface, which is a positive effect at the pickling. Further, an increased metal/metal oxide dissolving is obtained at the pickling in the presence of urea. What happens is probably, without limiting the invention to a given theory, that the nitrite ion is eliminated, whereby its inhibition effect is abolished, which implies an increased pickling speed. The inhibition may be explained through study of the partial progresses at the pickling. The speed of the pickling reaction is entirely prescribed by the number of ions being transported to the metal surface and also away from the surface. The higher concentration of the reaction products being present on the metal surface, the more ones are adsorbed on the surface. Said adsorption suppresses the pickling speed through a blocking of the metal. At a steady state condition, the reaction products are carried to the liquid phase at the same rate as they are formed. If urea is added to the solution, the concentration of nitrogen oxides in the liquid phase decreases, whereby the counter-pressure for the output of nitrous fumes is reduced. The consequence is that the nitrogen oxides are more rapidly removed from the surface and that the concentration there aims at a lower level to obtain a steady state condition. As a consequence hereof the pickling speed is increased. This implies also that the amount of nitric acid in the pickling agent according to the invention possibly can be reduced with maintained pickling efficiency.

Underlying Theories

When using conventional pickling agents based on a mixed acid, i.e. nitric acid ($HNO_3$) and hydrofluoric acid (HF), for the pickling treatment of oxidized stainless steels, metals and metal oxides are oxidized during the formation of $Cr^{3+}$, $Fe^{3+}$ and $Ni^{2+}$ ions. Then, $HNO_3$ is consumed and nitrous fumes ($NO_x$) are formed.

Metal dissolving reactions:

$$Fe+4H^{+}+NO_3^{-} \leftrightarrows Fe^{3+}+NO+2H_2O$$

$$Cr+4H^{+}+NO_3^{-} \leftrightarrows Cr^{3+}+NO+2H_2O$$

$$3Ni+8H^{+}+2NO_3^{-} \leftrightarrows 3Ni^{2+}+2NO+4H_2O \quad (1)$$

Oxide dissolving reactions:

$$3FeO.(Fe, Cr)_2O_3+28H^{+}+NO_3^{31} \leftrightarrows 6Fe^{3+}+3Cr^{3+}+14H_2O+NO$$

$$NiO+2H^{+} \leftrightarrows Ni^{2+}+H_2O \quad (2)$$

From the above formulas, it can be seen that in the first place $H^{+}$ is consumed at the reactions and that HF has not at all been involved. As a reaction, however, aims at a equilibrium, i.e. the condition when products are formed and re-formed at the same rate, HF plays an important role. This consists of forcing the reaction only to the right-hand side, i.e. to dissolve metal and oxide. With the metal ions arising at the dissolving reactions, the fluoride in HF forms stable complexes and prevents in this ways that the reaction stops. At the formation of complexes of fluoride the dissolution of metal and oxide is favored because the balance is displaced to the right-hand side when metal ions are consumed.

Reactions forming metal complexes:

$$3HF+Fe^{3+}\rightarrow FeF_3+3H^+$$

$$2HF+Fe^{3+}\rightarrow FeF_2^{+}+2H^+$$

$$3HF+Cr^{3+}\rightarrow CrF_3+3H^+$$

$$2HF+Cr^{3+}\rightarrow CrF_2^{+}+2H^+$$

$$HF+Ni^{2+}\rightarrow NiF^{+}+H^+ \quad (3)$$

At the dissolution reactions, nitrous fumes ($NO_x$) are formed, consisting of different nitrogen oxides: $NO_3$, $N_2O_5$, $N_2O_3$, $N_2O_4$, $N_2O$, NO, and $NO_2$. Some of them have a great tendency to decompose into NO and $NO_2$, which, in connection with pickling, implies that $NO_x$ is regarded as a mixture of NO and $NO_2$ (1:1). The gases formed at the dissolution is a prerequisite for the pickling process itself, as they increase the pressure under the oxide layer and practically blast the oxide.

Urea, which is also named ammonium carbamate ($(NH_2)_2CO$), is a colourless, grainy compound, which is easily dissolved in water (~500 g/l). Urea is also a comparatively inexpensive chemical product (appr. SEK 4:–/kg) as compared to other materials reducing $NO_x$, such as different solid peroxides. Urea does not react together with pure nitrogen monoxide or nitrogen dioxide. In the presence of strong acids, such as $HNO_3$, a formation of complexes however occurs, and then the complex of urea and nitric acid will react with nitrous acid under formation of nitrogen gas, cyanic acid, and water according to the formula:

$$(H_2N)_2CO+HNO_3\rightarrow(H_2N)_2CO.HNO_3$$

$$(H_2N)_2CO.HNO_3+HNO_2\rightarrow N_2+HNCO+2H_2O+HNO_3 \quad (4)$$

The cyanic acid (HNCO) formed is directly decomposed, either through attack by the nitrous acid or through hydrolysis.

$$HNCO+HNO_2\rightarrow CO_2+N_2+H_2O$$

$$HNCO+H_2O\rightarrow NH_3+CO_2 \quad (5)$$

The total reactions will then be the following:

$$(H_2N)_2CO+2HNO_2\rightarrow 2N_2+3H_2O+CO_2$$

$$(H_2N)_2CO+HNO_2\rightarrow N_2+NH_3+CO_2+H_2O \quad (6)$$

Decomposition of cyanic acid through hydrolysis occurs, when there is an excess of urea in relation to the nitric acid, the concentration of the nitrous acid is very low, or if the concentration of the nitric acid is so high that it neutralizes the ammonium formed. Said conditions will be met in a pickling agent, which implies that the last mentioned reaction will occur. The reaction products formed when cyanic acid has decomposed through hydrolysis and in presence of nitric acid are nitrogen gas, carbon dioxide, ammonium nitrate, and water. The reaction can be illustrated in the following way:

$$(NH_2)_2CO+HNO_2+HNO_3\rightarrow N_2+CO_2+NH_4NO_3+H_2O \quad (7)$$

To neutralize 1 kg nitrous acid 1.66 kg urea is theoretically needed, whereby 1.7 kg ammonium nitrate, 22.41 carbon dioxide, and 22.41 nitrogen gas, as well as 0.38 kg water is formed. According to T. W. Price, J Chem. Soc., 115, 1919, 1354–60, and E. A. Werner, J Chem. Soc., 118, 1920, 1078–81, examinations have been made concerning the degradation rate of urea in presence of nitric acid. However, they have found that below a temperature of 60° C., said degradation should be so slow that it was negligible.

Preferred Embodiments

Preferably, the pickling agent, in addition to urea and nitric acid as mentioned above, also includes hydrofluoric acid, suitably in an amount of 3 to 8 percent by weight, preferably 4 to 7 percent by weight, and still more preferred 5 to 6 percent by weight. Alternatively, or in combination, the pickling agent may comprise sulphuric acid, suitably in an amount of up to 10 percent by weight, preferably 0.1 to 5 percent by weight, and still more preferred 0.2 to 3 percent by weight. Also other acids or salts of acids may, however, be used in varying amounts. Especially for the pickling liquid, an addition of sulphuric acid has proved to be able to give an improved consistency and distribution of the liquid on the steel, when using the liquid.

The pickling agent, in the form of a paste, gel or spray liquid, includes preferably also an addition of a filler in the form of a powder, said filler preferably constituting of an inorganic thickener, preferably an oxide of an alkali earth metal, preferably in an amount of 2 to 30 percent by weight. A filler of MgO in an amount of 2 to 15 percent by weight, preferably 2 to 10 percent by weight, is the most preferred. Also $Al_2O_3$ in an amount of 5 to 30 percent by weight, preferably 10 to 25 percent by weight, may be used alone, or in combination with MgO. The function of the filler is to give the pickling agent the correct viscosity and consistency for simple treatment when it is used for pickling.

Suitable amounts of fillers differs for pastes/gels as compared to liquids, as follows. For pickling pastes or pickling gels, which shall show a creme/paste/ointment-like consistency, an addition of $Al_2O_3$ and MgO in the above mentioned amount should be used. For spray liquids, which shall have a consistency like sour milk in order not to flow off from the steel too rapidly, $Al_2O_3$ is preferably not used but MgO in an admixed amount of 2 to 10 percent by weight, preferably 2 to 6 percent by weight.

The remainder of the pickling agent consists of water.

At the manufacture of the pickling agent according to the invention, one normally starts out with urea of a technical grade, which is dissolved in water to a substantially saturated solution, about 300 to 500 g/l at room temperature, before it is added to the pickling agent. Especially for a pickling paste, it may be preferred to add the urea in this way in the form of a aqueous solution. For the pickling liquid, however, it has proved that an admixture of urea in solid condition directly into the pickling liquid results in a more even distribution of the pickling liquid on the steel at the use of the pickling liquid.

Further, during the development of the invention, it has proved that the urea solution suitably should be added to the pickling agent at a final stage of the manufacturing, when the pickling agent has cooled off. During the initial manufacturing process for the pickling agent, i.e. the mixture of the different acids and fillers, reaction temperatures of normally about 45–50° C. are reached. At said temperatures a certain emission of $NO_x$ from the pickling agent occurs. If the urea then is already added, this implies that a premature consumption of urea will take place. According to the invention, the urea solution is therefore not added until the pickling agent has cooled to about 30° C. or less, preferably 25° C. or less. At said lower temperatures, the $NO_x$-emission has ceased, or substantially ceased, and therefore the problem of premature urea consumption is avoided.

EXAMPLE 1

Figure 1:
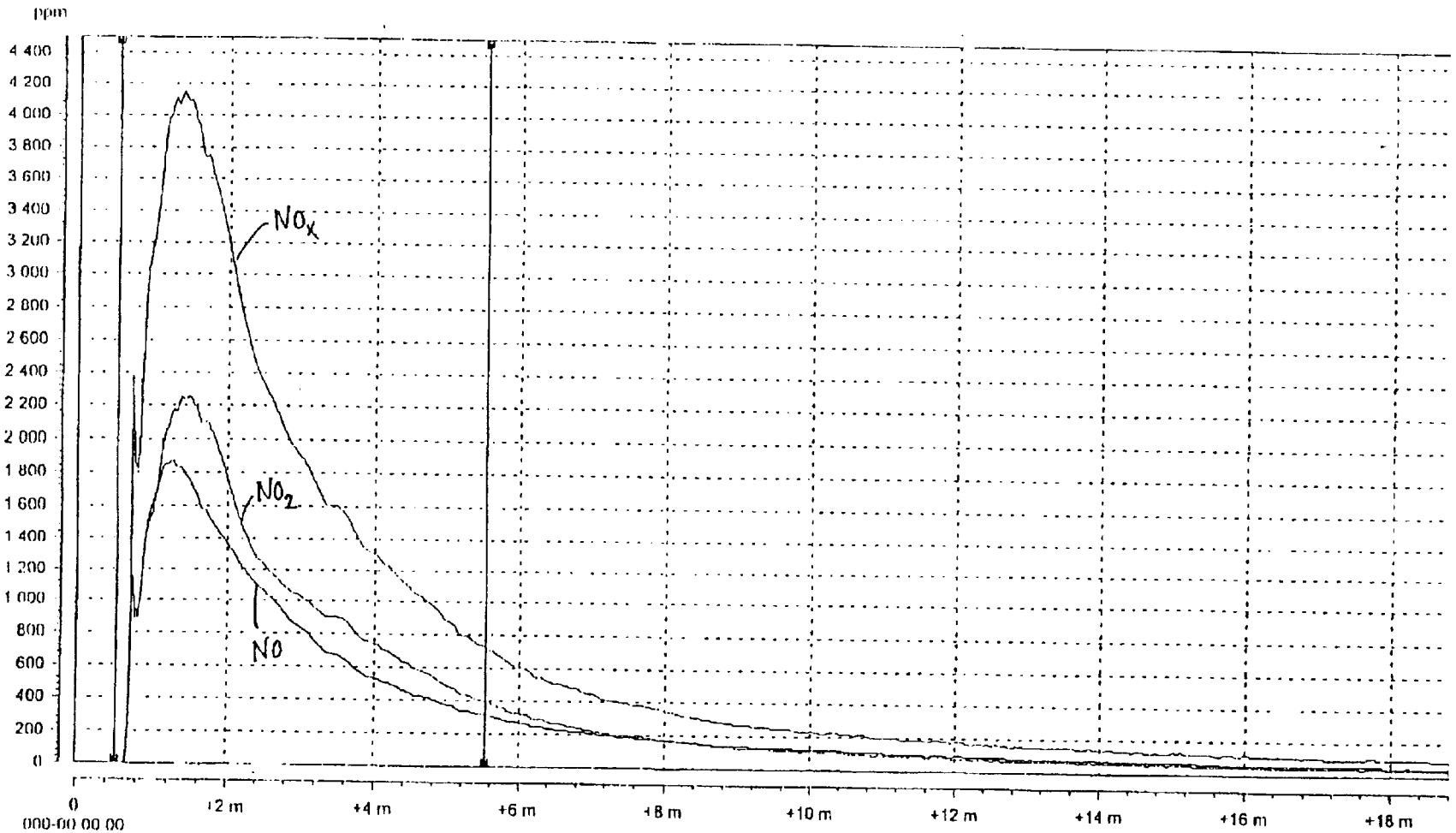
FIG. 1 shows an example of a measured reference graph at laboratory tests performed with pickling gel without urea.

A series of tests was performed in a laboratory with the aim to study the $NO_x$-reducing effect of urea in pickling agents and to study the long-time stability of pickling agents containing urea.

A saturated solution of urea in water (500 g/l) was manufactured and added to the existing pickling gel of the type 122 from the company Avesta Welding by adding given amounts of an urea solution to 100 ml of a pickling gel followed by a thorough stirring. The different concentrations which were tested as to pickling ability and $NO_x$-reduction were then 20, 40, 80, and 160 g/l. The samples were stored in 250 ml plastic bottles with covers at a comparatively high room temperature (for the most part almost 30° C.) and partly directly in sunlight. The storage time varied from 24 hours to about two months in order to study the stability of the pickling gel in the presence of urea.

The pickling gel 122 from the company Avesta Welding, which was used in the tests, comprises 22 percent by weight of nitric acid, 5 percent by weight of hydrofluoric acid, 7.5 percent by weight of MgO, balance water.

In the tests performed, where urea had been admixed to the existing pickling gels, no consideration has been taken to the occurring dilution of the acids present in the pickling gel. The different concentrations, which were tested as to pickling ability and $NO_x$-reduction, were as mentioned above, 20, 40, 80, and 160 g/l of urea, which corresponds to 4, 8, 16, and 32 ml, respectively, of urea solution and a dilution of equal percentage. It is difficult to compensate the dilution through reducing the amount of water in the pickling gel used as a starting agent. The dilution has, however, no direct influence on the pickling result, as the pickling efficiency increases when urea is present.

At the tests, each sample of the pickling gel was pencilled to form a layer, about 1 to 1.5 mm thick, on an oxidized sheet, 10×4 cm, of stainless steel (18-8 steel of the type 304), i.e. about 4 to 6 ml of the pickling agent was needed for each sheet. The amount of nitrous fumes, which were emitted at the reaction between the pickling agent and the metal/metal oxides, was measured by a chemical luminescence instrument. The measurement of the nitrous fumes continued during 45 minutes, and then the piece of sheet was cleaned by high pressure. Then, the sheet was dried and the pickling result appeared. As reference, the pickling gel of the type 122 from Avesta Welding without addition of urea, was analysed in three samples. The result of the reference samples, reported as maximum emission of NO, $NO_2$, and maximum emission of $NO_x$, is shown in Table 1. The difference between the $NO_x$-values and the $NO+NO_2$-values depends on inaccuracy in measurements.

TABLE 1

Reference analysis of pickling gel of the type Avesta Welding 122 without any addition of urea.

| Sample | Maximum emission of NO (ppm) | Maximum emission of $NO_2$ (ppm) | Maximum emission of $NO_x$ (ppm) |
|---|---|---|---|
| 1 | 1656 | 2420 | 4092 |
| 2 | 1939 | 2615 | 4631 |
| 3 | 1868 | 2258 | 4153 |

The varying values between different analyses depend on the difficulties to add exactly the same amount of pickling gel on each plate from case to case. A larger amount of gel will therefore give a higher value in the analysis.

The results of the tests according to the invention are shown in Table 2. The pickling agents used according to Table 2 had been stored for 58 days under the above mentioned conditions.

TABLE 2

Pickling gel of the type Avesta Welding 122 with different concentrations of urea, which gel was analysed after a storage period of 58 days.

| Sample | Concentration of urea (g/) | Maximum emission of $NO_x$ (ppm) |
|---|---|---|
| 6 | 20 | 2288 |
| 12 | 40 | 2064 |
| 20 | 80 | 796 |
| 27 | 160 | 194 |

As can be seen from Table 2, the presence of urea implies a considerable reduction of the formation of $NO_x$, Already at an urea amount of 20 g/l the maximum emission of $NO_x$ is more than 40% lower than for the reference, and at an urea amount of 40 g/l it is half as high as the reference according to Table 1. At still higher amounts of urea, the maximum emission of $NO_x$ is further reduced very drastically, a reduction of up to 80% and 95% at 80 g/l and 160 g/l, respectively.

In order to study the size of possible degradation effect of storage time of the samples, the samples were evaluated at different amounts of urea at different moments during the storage. The results are shown in Table 3.

TABLE 3

Pickling gel of the type Avesta Welding 122 with different concentrations of urea, which gel was analysed after differing storage time.

| Sample | Concentration of of urea (g/l) | Storage time (days) | Maximum emission of $NO_x$ (ppm) |
|---|---|---|---|
| 1 | 20 | 0 | 2387 |
| 2 | 20 | 1 | 2689 |
| 3 | 20 | 2 | 2641 |
| 4 | 20 | 7 | 2649 |
| 5 | 20 | 30 | 2196 |
| 6 | 20 | 58 | 2288 |
| 7 | 40 | 0 | 1358 |
| 8 | 40 | 1 | 1328 |
| 9 | 40 | 2 | 1225 |
| 10 | 40 | 7 | 1448 |
| 11 | 40 | 30 | 1681 |
| 12 | 40 | 58 | 2064 |

TABLE 3-continued

Pickling gel of the type Avesta Welding 122 with different concentrations of urea, which gel was analysed after differing storage time.

| Sample | Concentration of of urea (g/l) | Storage time (days) | Maximum emission of $NO_x$ (ppm) |
|---|---|---|---|
| 12a | 40 | 300 | 1841 |
| 13 | 80 | 0 | 509 |
| 14 | 80 | 1 | 480 |
| 15 | 80 | 2 | 480 |
| 16 | 80 | 7 | 711 |
| 17 | 80 | 20 | 856 |
| 18 | 80 | 21 | 627 |
| 19 | 80 | 30 | 766 |
| 20 | 80 | 58 | 796 |
| 20a | 80 | 300 | 1078 |
| 21 | 160 | 0 | 167 |
| 22 | 160 | 1 | 167 |
| 23 | 160 | 2 | 188 |
| 24 | 160 | 7 | 207 |
| 25 | 160 | 20 | 188 |
| 26 | 160 | 30 | 199 |
| 27 | 160 | 58 | 194 |
| 27a | 160 | 300 | 145 |

The results in Table 3 show that the storage time does not to any appreciable extent influence the $NO_x$-reducing effect due to the presence of urea in the pickling agent, and they also verify the levels shown in Table 2. The visual judgement of the pickling result proved that a satisfactory pickling was achieved with all samples.

Figure 2:
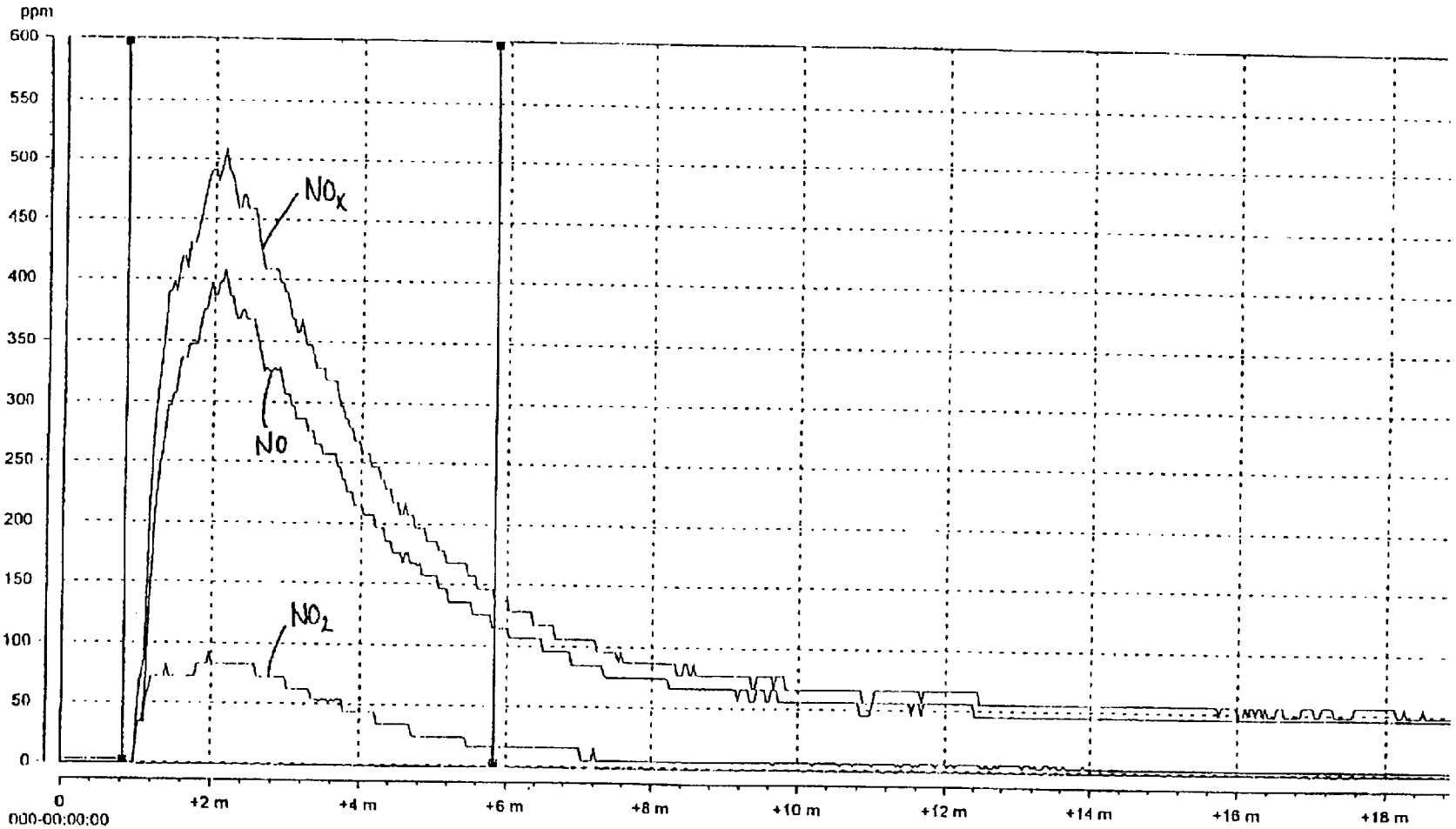
FIG. 2 shows an example of a measured graph according to the invention at laboratory tests performed with pickling gel with 80 g/l urea.

As examples, FIGS. 1 and 2 show graphs of the emission of NO, $NO_2$, and $NO_x$, respectively, in ppm as a function of the time in minutes for reference sample No. 3 (FIG. 1) according to the above, as well as the sample No. 13 according to the invention (FIG. 2) according to the above. The figures confirm that the presence of urea reduces the indicated contents as well as displaces the formation of $NO_x$ from substantially $NO_2$ to essentially NO.

EXAMPLE 2

A test in a large scale with 80 g/l urea in the pickling liquid for spray pickling was performed. The liquid was caused to mature during 24 hours after the addition of urea, before the test was performed. The pickling was performed on a large scale in a testing chamber of about 100 l and a sheet of about 0.5 $m^2$ of a 18-8 steel. The pickling solution was applied through spray pickling with an acid resistant diaphragm pump. The pickling gel of the type 122 from Avesta Welding, which was used in the tests, comprises 22 percent by weight of nitric acid, 5 percent by weight of hydrofluoric acid, 4 percent by weight of MgO, balance water.

Figure 3:
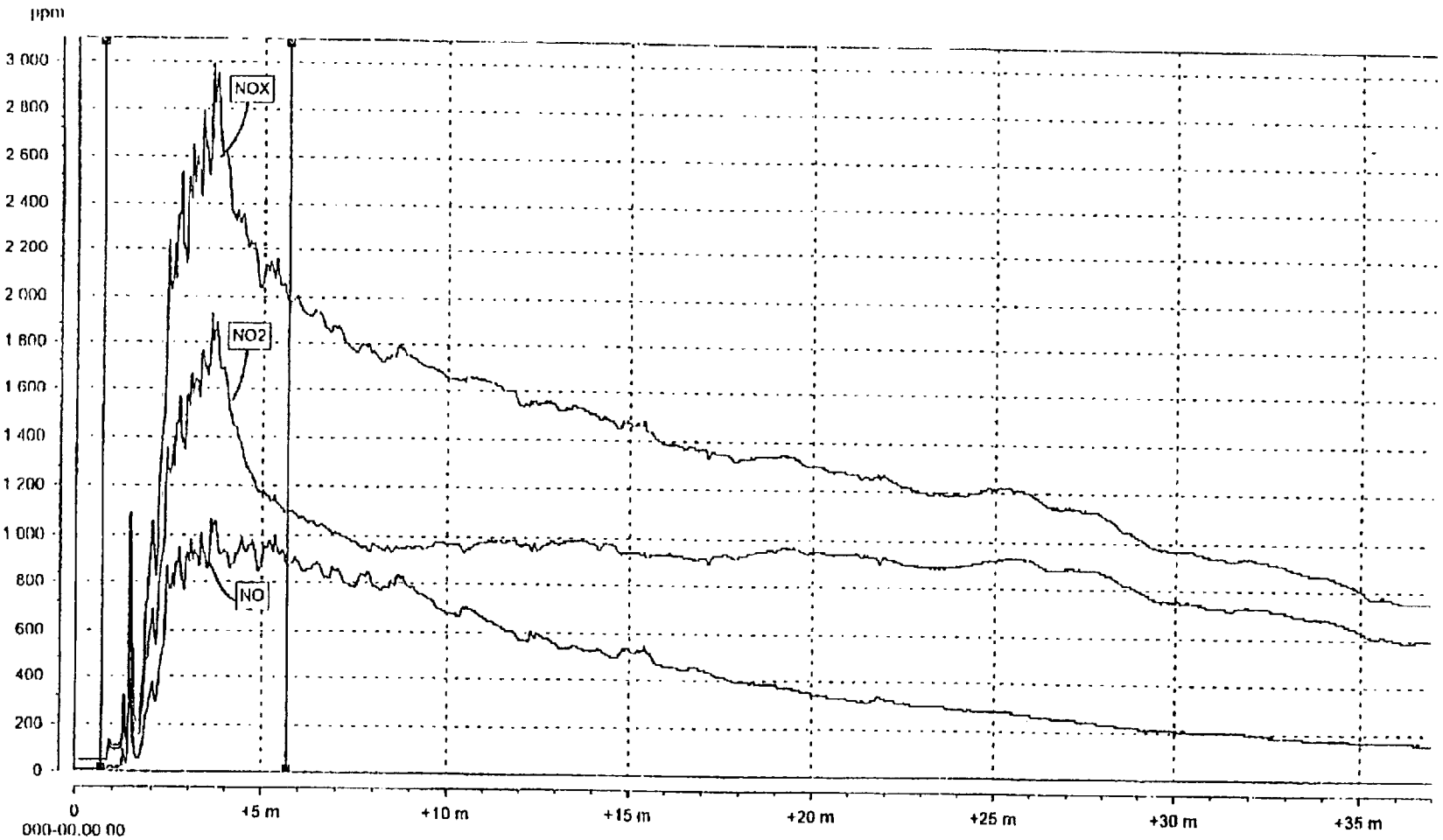
FIG. 3 shows an example of a measured reference graph at large scale tests performed with pickling liquid without urea.
Figure 4:
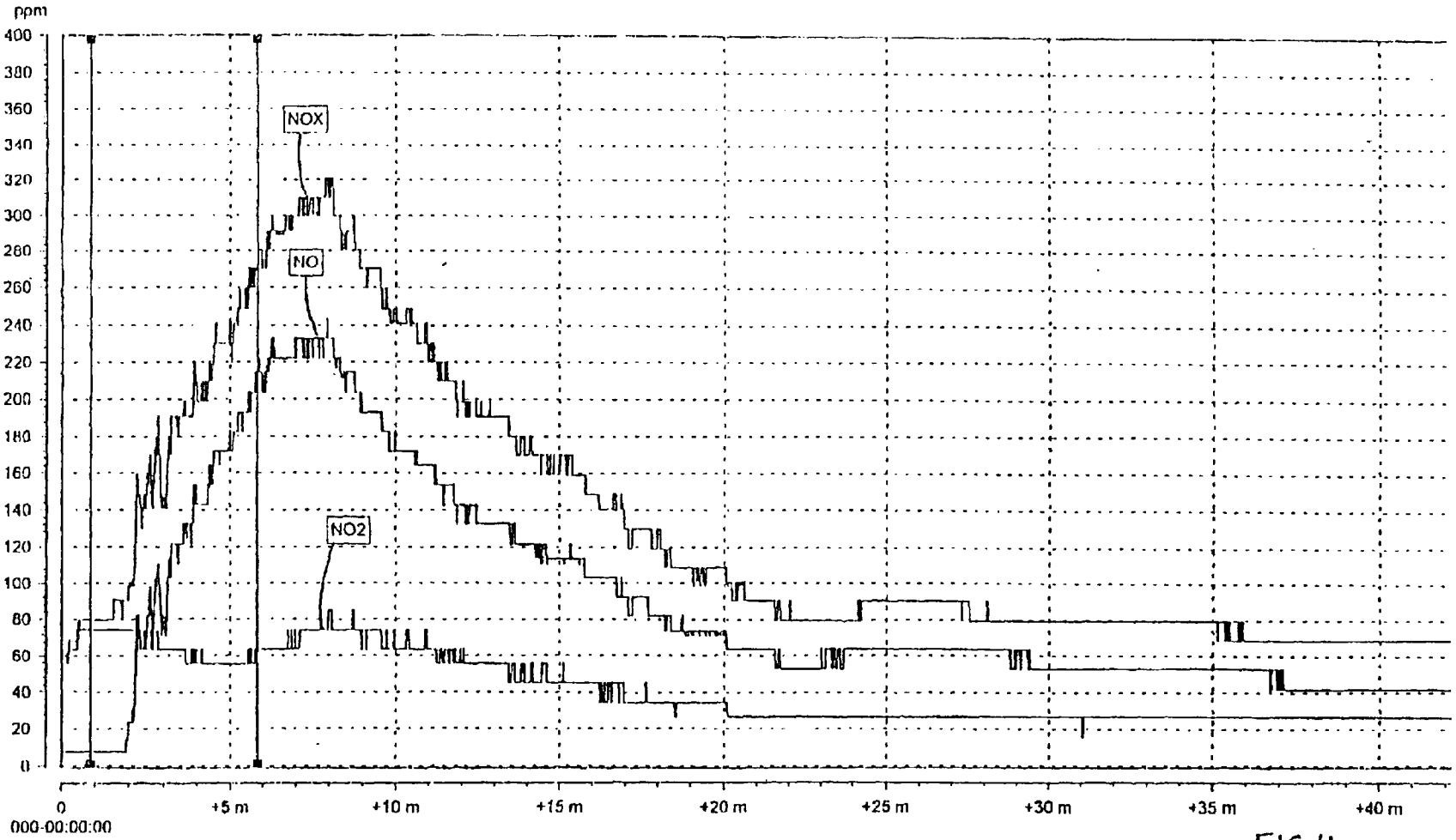
FIG. 4 shows an example of a measured graph according to the invention at large scale tests performed with pickling liquid with 80 g/l urea.

The results of the measurement with the chemical luminescent instrument are shown in FIG. 3 (reference, without urea) and FIG. 4 (tests according to the invention). The maximum $NO_x$-emission during the reference test was 2991 ppm and during the test according to the invention 321 ppm, which implies a reduction by 90%.

The visual judgement of the pickling result proved that a satisfactory pickling had been achieved for all samples.

EXAMPLE 3

A large scale test with 150 g/l urea in the pickling liquid for spray pickling was performed in the same way as in Example 2. Then, differences in the pickling results was evaluated depending on the fact whether urea had been added to the pickling liquid in the form of an aqueous solution or directly in a solid condition. Visual judgement proved that the most even distribution of the liquid was obtained when the urea had been added in a solid condition directly into the pickling liquid, which also resulted in the most even pickling result. Even when urea had been added as an aqueous solution, a satisfactory pickling was however obtained.

EXAMPLE 4

A pickling gel with an addition of 80 g/l urea and a pickling liquid with an addition of 160 g/l urea was analysed with an instrument, Scanacon SA-20, intended for the analysis of free active acids in pickling agents. The purpose was to establish if the acid concentration is changed, when there is urea present in the solution. The results of the different analyses are shown in Table 4.

TABLE 4

Analysis of acids in pickling solutions

| Sample | Concentration of HF (g/l) | Concentration of $HNO_3$ (g/l) |
|---|---|---|
| Pickling gel + urea | 79 | 280 |
| Pickling gel + urea after one week | 81 | 302 |
| Pickling liquid + urea | 84 | 207 |
| Pickling liquid + urea after one week | 93 | 182 |

The result shows that even after a storage time of 7 days, there are no traces of changes in the composition of pickling gel of the type 122. The content of nitric acid in the pickling acid of the type 204 has, however, decreased somewhat after a storage time of 7 days. This fact can be compensated by an increased content of nitric acid from the beginning.

The invention is not limited to the examples shown above but can be varied within the scope of the claims. Particularly, it should be noted that the composition of the pickling agent may vary, but it is, however, necessary for the invention that some component emitting nitrous fumes is present at the pickling of the oxidized stainless steel, and of course also that urea is present to suppress said emission of nitrous fumes.

What is claimed is:

1. A pickling agent for the removal of an oxide layer on stainless steel after heat treatment, such as welding, which pickling agent comprises nitric acid and a filler, said filler comprising a pulverous, inorganic thickener in an amount of 2 to 30 percent by weight, said pickling agent being a pickling paste or pickling gel suitable for coating on the heat treated stainless steel, or a pickling liquid suitable for spraying on the steel, wherein said pickling agent also comprises at least 60 g/l of urea for reduced formation of nitrous fumes during use of the pickling agent, and wherein the pickling agent exhibits long term stability when stored at room temperature.

2. A pickling agent according to claim 1, wherein said urea is present in an amount of at least 80 g/l.

3. A pickling agent according to claim 1, wherein said urea is present in an amount of 160 g/l at most.

4. A pickling agent according to claim 1, wherein said nitric acid is present in an amount of 15 to 30 percent by weight.

5. A pickling agent according to claim 1, wherein said nitric acid is present in an amount of 17 to 27 percent by weight.

6. A pickling agent according to claim 1, wherein said nitric acid is present in an amount of 19 to 25 percent by weight.

7. A pickling agent according to claim 1, further comprising hydrofluoric acid in an amount of 3 to 8 percent by weight and/or sulphuric acid in an amount of up to 10 percent by weight.

8. A pickling agent according to claim 1, further comprising hydrofluoric acid in an amount of 4 to 7 percent by weight and/or sulphuric acid in an amount of 0.1 to 5 percent by weight.

9. A pickling agent according to claim 1, further comprising hydrofluoric acid in an amount of 5 to 6 percent by weight and/or sulphuric acid in an amount of 0.2 to 3 percent by weight.

10. A pickling agent according to claim 1, wherein said filler is an oxide of an alkaline earth metal.

11. Pickling agent according to claim 10, wherein said filler comprises $Al_2O_3$ in an amount of 5 to 30 percent by weight and/or $M_gO$ in an amount of 2 to 15 percent by weight.

12. Pickling agent according to claim 10, wherein said filler comprises $Al_2O_3$ in an amount of 10 to 25 percent by weight, and/or $M_gO$ in an amount of 2 to 10 percent by weight.

13. A method for manufacturing a pickling agent according to claim 1, wherein said urea is added when the pickling agent has a temperature below 30° C.

14. A method for manufacturing a pickling agent according to claim 1, wherein said urea is added when the pickling agent has a temperature below 25° C. in a final stage of the manufacturing when the pickling agent has cooled off.

15. A method for manufacturing a pickling agent according to claim 13, wherein said urea is added to the pickling agent as an aqueous solution which is substantially saturated at room temperature at about 300 to 500 g/l.

16. A method for manufacturing a pickling agent according to claim 15, wherein said pickling agent is in the form of a pickling paste or pickling gel.

17. A method according to claim 13, wherein said urea is added to the pickling agent in a solid state.

18. A method according to claim 17, wherein said pickling agent is a pickling liquid.

19. A method of removing an oxide layer present on a stainless steel after heat treatment, comprising the steps of:

coating said stainless steel with a pickling agent as defined in claim 1; and rinsing said pickling agent off the stainless steel with water after said pickling agent has acted on said oxide layer.

20. A pickling agent according to claim 1, wherein said pickling agent is stable for a period of about 300 days.

* * * * *

UNITED STATES PATENT AND TRADEMARK OFFICE

CERTIFICATE OF CORRECTION

PATENT NO. : 6,844,304 B2
APPLICATION NO. : 10/168990
DATED : January 18, 2005
INVENTOR(S) : Lunner et al.

It is certified that error appears in the above-identified patent and that said Letters Patent is hereby corrected as shown below:

Front page of the patent, left hand column (73) "Assignee", please delete "Avestapolarit Aktiebolag (Publ)", and insert --Outokumpu Stainless Aktiebolag--.

Signed and Sealed this

Seventeenth Day of October, 2006

JON W. DUDAS
*Director of the United States Patent and Trademark Office*